US009014383B2

(12) United States Patent
Kanishima et al.

(10) Patent No.: US 9,014,383 B2
(45) Date of Patent: Apr. 21, 2015

(54) SOUND PROCESSOR, SOUND PROCESSING METHOD, AND COMPUTER PROGRAM PRODUCT

(71) Applicant: Kabushiki Kaisha Toshiba, Tokyo (JP)

(72) Inventors: Yasuhiro Kanishima, Suginami-ku (JP); Toshifumi Yamamoto, Hino (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 299 days.

(21) Appl. No.: 13/771,517

(22) Filed: Feb. 20, 2013

(65) Prior Publication Data

US 2013/0315405 A1 Nov. 28, 2013

(30) Foreign Application Priority Data

May 24, 2012 (JP) ..... 2012-118749

(51) Int. Cl.
*H04R 29/00* (2006.01)
*H04S 7/00* (2006.01)

(52) U.S. Cl.
CPC ..... *H04R 29/00* (2013.01); *H04S 7/302* (2013.01); *H04S 7/307* (2013.01); *H04R 2420/07* (2013.01); *H04S 2400/15* (2013.01)

(58) Field of Classification Search
None
See application file for complete search history.

(56) References Cited

U.S. PATENT DOCUMENTS 5,239,586 A * 8/1993 Marui ..... 381/107
5,581,621 A 12/1996 Koyama et al.
8,630,423 B1 * 1/2014 Elliott ..... 381/58
2003/0179891 A1 * 9/2003 Rabinowitz et al. ..... 381/103
2005/0069153 A1 * 3/2005 Hall et al. ..... 381/56
2007/0253559 A1 * 11/2007 Vernon ..... 381/56
2010/0272270 A1 * 10/2010 Chaikin et al. ..... 381/59
2011/0208516 A1 * 8/2011 Kuboyama ..... 704/205
2013/0058492 A1 * 3/2013 Silzle et al. ..... 381/59
2013/0066453 A1 * 3/2013 Seefeldt ..... 700/94

FOREIGN PATENT DOCUMENTS

JP 03-029360 4/1991
JP 06-311591 11/1994
JP 2006-340285 12/2006
JP 2007-259391 10/2007

* cited by examiner

*Primary Examiner* — Thang Tran
(74) *Attorney, Agent, or Firm* — Blakely Sokoloff Taylor & Zafman LLP

(57) ABSTRACT

According to one embodiment, sound processor includes: communication module; outputting module; recording module; display; input module; controller; and calculating module. The controller (i) displays, on display, message prompting user to move a sound input device to position proximate to speaker, (ii) causes the outputting module to output the test sound and causes the recording module to record first sound, (iii) displays, after the first sound is recorded, on the display, message prompting the user to move the sound input device to listening position, and (iv) causes the outputting module to output the test sound and causes the recording module to record second sound. The calculating module finds a first frequency characteristic of the first sound and a second frequency characteristic of the second sound, and calculates, based on a difference between the first and second frequency characteristics, a value for correcting the second frequency characteristic to a target frequency characteristic.

7 Claims, 11 Drawing Sheets

SOUND PROCESSOR, SOUND PROCESSING METHOD, AND COMPUTER PROGRAM PRODUCT

CROSS-REFERENCE TO RELATED APPLICATIONS

This application is based upon and claims the benefit of priority from Japanese Patent Application No. 2012-118749, filed May 24, 2012, the entire contents of which are incorporated herein by reference.

FIELD

Embodiments described herein relate generally to a sound processor, a sound processing method, and a computer program product.

BACKGROUND

There is known a sound correction system in which frequency characteristics of spatial sound fields of an audio device are corrected to be adequate for a listener position. In the sound correction system, for example, given test sound (white noise, etc.) is output from a speaker of an audio device, and the sound is collected with a microphone arranged at a listener's position. Then, the frequency characteristics of the sound are analyzed to calculate a correction value for obtaining a target frequency characteristic. The sound correction system adjusts an equalizer of the audio device based on the calculated correction value. Thus, the listener can listen to sound having the target frequency characteristics obtained through correction that is output from the audio device.

There is also known a sound correction system in which test sound is collected using a mobile terminal with a microphone embedded, such as a smartphone (multifunctional mobile phone, personal handyphone system (PHS)). In this case, the mobile phone collects test sound output from a speaker of an audio device using an embedded microphone, and transmits measured data or analysis results of the measured data to the audio device. The use of such a mobile terminal can reduce costs of the sound correction system.

In the conventional sound correction system, a correction value calculated based on analysis results of collected sound depends on the quality of a microphone (quality of measuring system) used for collecting sound. For example, the microphones of mobile terminals have different specifications depending on manufacturers, models, etc. In a mobile terminal, an inexpensive microphone may be used to reduce costs. Such inexpensive microphones cause process variations. Thus, the reliability of frequency characteristic measurement results is deteriorated.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

In general, according to one embodiment, a sound processor comprises: a communication module; a test sound outputting module; a recording module; a display; an input module; a controller; and a calculating module. The communication module is configured to communicate with a sound device. The test sound outputting module is configured to cause the sound device to output test sound through the communication module. The recording module is configured to record sound collected with a sound input device. The display is configured to display a message. The input module is configured to receive a user input. The controller configured to (i) display, on the display, a first message prompting a user to move the sound input device to a position proximate to a speaker of the sound device so as to record first sound, (ii) cause the test sound outputting module to output the test sound in accordance with a user input made with respect to the input module in response to the first message and cause the recording module to record the first sound, (iii) display, after the first sound is recorded, on the display, a second message prompting the user to move the sound input device to a listening position so as to record second sound, and (iv) cause the test sound outputting module to output the test sound in accordance with a user input made with respect to the input module in response to the second message and cause the recording module to record the second sound. The calculating module is configured to find a first frequency characteristic of the first sound recorded with the recording module and a second frequency characteristic of the second sound recorded with the recording module, and calculate, based on a difference between the first frequency characteristic and the second frequency characteristic, a correction value for correcting the second frequency characteristic to a target frequency characteristic.

Figure 1:
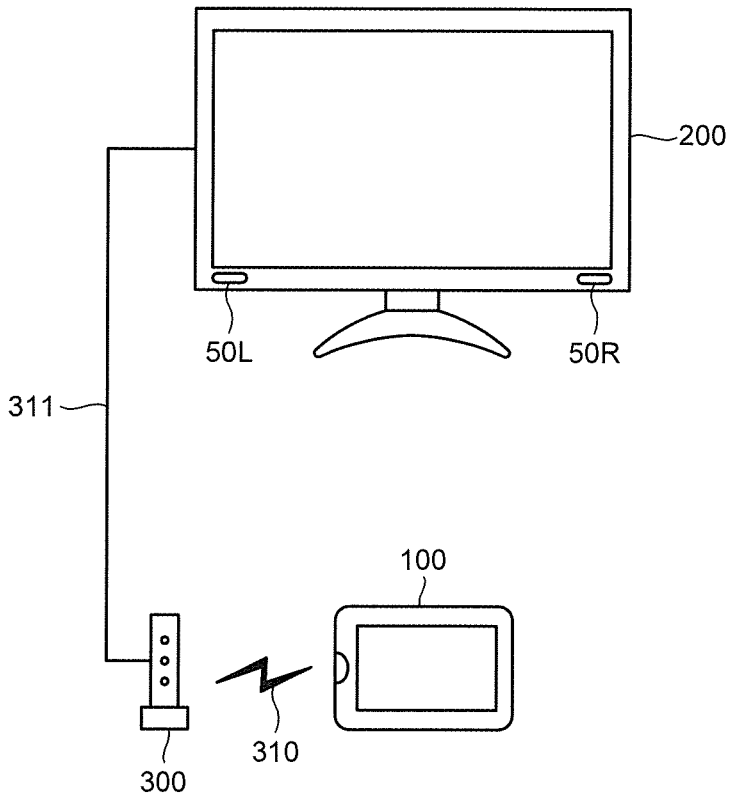
FIG. 1 is an exemplary diagram of a configuration of a sound processing system to which a sound processor can be applied, according to an embodiment.

In the following, a sound processor of an embodiment is described. FIG. 1 illustrates a configuration of an example of a sound processing system to which the sound processor of the embodiment can be applied. The sound processing system comprises a mobile terminal 100, a sound device 200, and a wireless transceiver 300.

The mobile terminal 100 is a smartphone (multifunctional mobile phone, PHS), or a tablet terminal, for example. The mobile terminal 100 has a microphone, a display and a user input module, and can perform, using a given protocol, communication with external devices through wireless radio waves 310. The mobile terminal 100 uses, for example, a transmission control protocol/internet protocol (TCP/IP) as a protocol.

The sound device 200 has speakers 50L and 50R to output audio signals as sound therefrom. In the embodiment, the sound device 200 is a television receiver supporting terrestrial digital broadcasting, and thus can output audio signals of terrestrial digital broadcasting or audio signals input from an external input terminal (not illustrated) as sound from the speakers 50L and 50R.

The wireless transceiver 300 is connected to the sound device 200 through a cable 311 to perform, using a given protocol, wireless communication with the outside through the wireless radio waves 310. The wireless transceiver 300 is a so-called wireless router, for example. As a communication protocol, the TCP/IP can be used, for example.

In the example of FIG. 1, the sound device 200 and the wireless transceiver 300 are connected to each other through the cable 311, and the sound device 200 performs communication with the mobile terminal 100 through the cable 311 using the wireless transceiver 300 as an external device. However, the embodiments are not limited thereto. That is, the wireless communication may be performed directly between the sound device 200 and the mobile terminal 100. For example, when a wireless transmitting and receiving module that realizes functions of the wireless transceiver 300 is embedded in the sound device 200, the direct wireless communication becomes possible between the sound device 200 and the mobile terminal 100.

Figure 2:
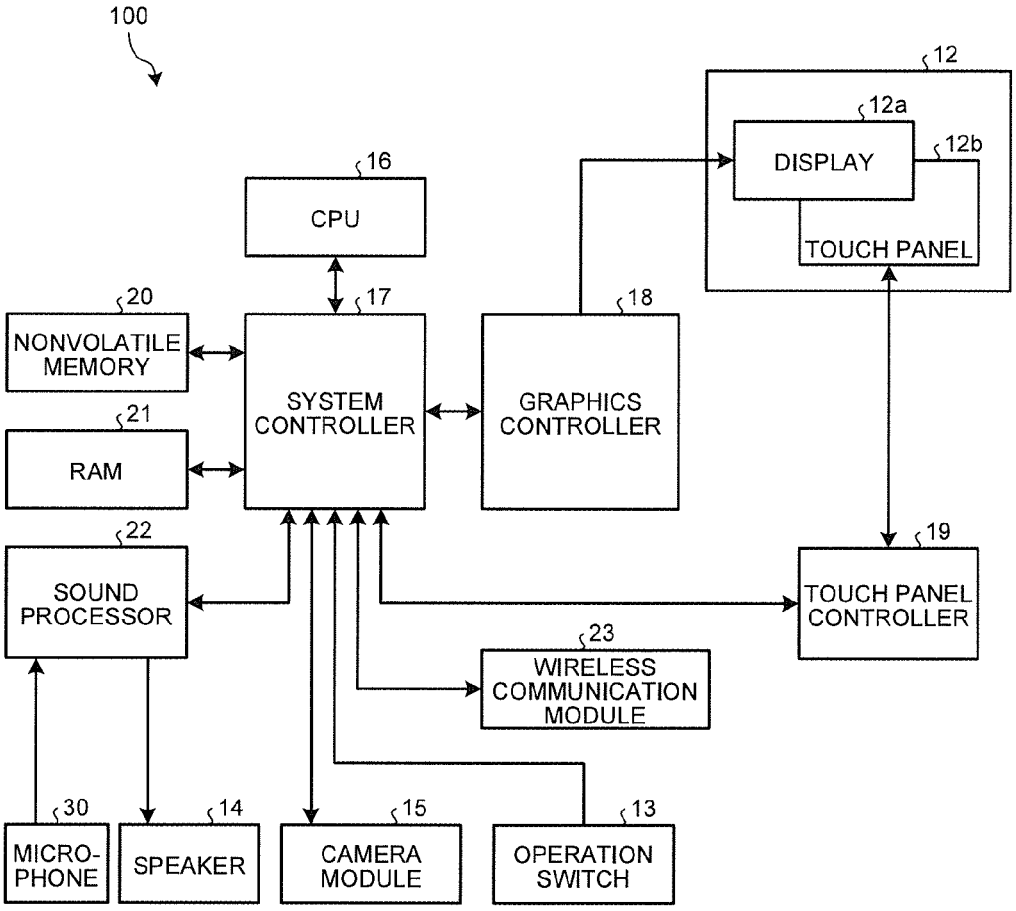
FIG. 2 is an exemplary block diagram of a configuration of a mobile terminal in the embodiment.

FIG. 2 illustrates a configuration of an example of the mobile terminal 100. As exemplified in FIG. 2, the mobile terminal 100 comprises an user interface 12, an operation switch 13, a speaker 14, a camera module 15, a central processing unit (CPU) 16, a system controller 17, a graphics controller 18, a touch panel controller 19, a nonvolatile memory 20, a random access memory (RAM) 21, a sound processor 22, a wireless communication module 23, and a microphone 30.

In the user interface 12, a display 12*a* and a touch panel 12*b* are constituted in an integrated manner. A liquid crystal display (LCD) or an electro luminescence (EL) display, for example, can be applied as the display 12*a*. The touch panel 12*b* is configured to output control signals depending on a position pressed so that an image on the display 12*a* is transmitted.

The CPU 16 is a processor integrally controlling actions of the mobile terminal 100. The CPU 16 controls each module of the mobile terminal 100 through the system controller 17. The CPU 16 controls actions of the mobile terminal 100 with the RAM 21 as a work memory, in accordance with a computer program preliminarily stored in the nonvolatile memory 20, for example. In the embodiment, the CPU 16 executes especially a computer program for correcting sound frequency characteristics of spatial sound fields (hereinafter referred to as "frequency characteristic correction program") to realize sound frequency characteristic correction processing, which is described later with referring to FIG. 5 and the figures following it.

The nonvolatile memory 20 stores therein various data necessary for executing the operation system, various application programs, etc. The RAM 21 provides, as a main memory of the mobile terminal 100, a work area used when the CPU 16 executes the program.

The system controller 17 has therein a memory controller controlling access by the CPU 16 to the nonvolatile memory 20 and the RAM 21. The system controller 17 controls communication between the CPU 16 and the graphics controller 18, the touch panel controller 19 and the sound processor 22. User operation information received by the operation switch 13 and image information from the camera module 15 are provided to the CPU 16 through the system controller 17.

The graphics controller 18 is a display controller controlling the display 12*a* of the user interface 12. For example, display control signals generated by the CPU 16 in accordance with the computer program are supplied to the graphics controller 18 through the system controller 17. The graphics controller 18 converts supplied display control signals into signals that can be displayed on the display 12*a*, and transmits the resulting signals to the display 12*a*.

Based on the control signals output from the touch panel 12*b* depending on a pressed position, the touch panel controller 19 calculates coordinate data specifying the pressed position. The touch panel controller 19 supplies the calculated coordinate data to the CPU 16 through the system controller 17.

The microphone 30 is a sound input device collecting sound, converting it into audio signals that are analog electrical signals, and then outputting the audio signals. The audio signals output from the microphone 30 are supplied to the sound processor 22. The sound processor 22 performs analog to digital (A/D) conversion on the audio signals supplied from the microphone 30, and outputs the resulting signals as audio data.

The audio data output from the sound processor 22 is stored in the nonvolatile memory 20 or the RAM 21 through the system controller 17, under control of the CPU 16, for example. The CPU 16 can perform given processing on the audio data stored in the nonvolatile memory 20 or the RAM 21, in accordance with the computer program. In the following, the action of storing audio data resulted by A/D conversion of audio signals supplied from the microphone 30 in the nonvolatile memory 20 or the RAM 21, according to orders of the CPU 16, is referred to as recording.

The speaker 14 converts the audio signals output from the sound processor 22 into sound, and outputs it. For example, the sound processor 22 converts audio data generated through sound processing such as sound synthesis under control of the CPU 16 into analog audio signals, and supplies them to the speaker 14 and causes the speaker 14 to output them as sound.

The wireless communication module 23 performs wireless communication with external devices using a given protocol (TCP/IP, for example) under control of the CPU 16 through the system controller 17. For example, the wireless communication module 23 performs wireless communication with the wireless transceiver 300 (see FIG. 1) under control of the CPU 16, thus allowing communication between the sound device 200 and the mobile terminal 100.

Figure 3:
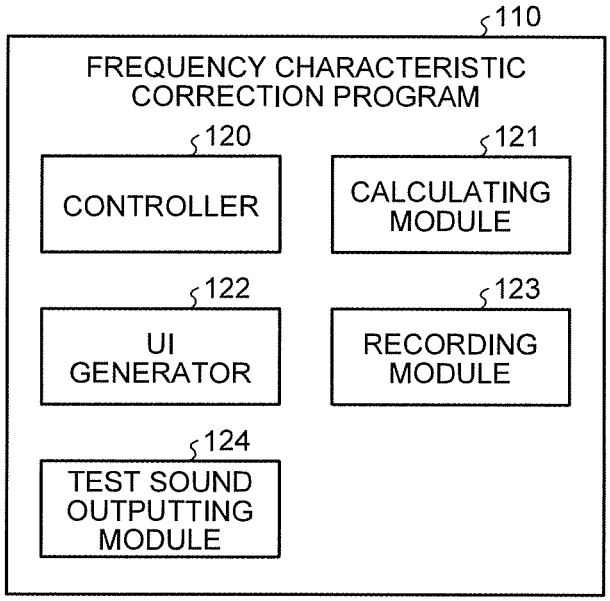
FIG. 3 is an exemplary functional block diagram illustrating functions of a frequency characteristic correction program in the embodiment.

FIG. 3 is a functional block diagram illustrating functions of a frequency characteristic correction program 110 that operates on the CPU 16. The frequency characteristic correction program 110 comprises a controller 120, a calculating module 121, a user interface (UI) generator 122, a recording module 123, and a test sound outputting module 124.

The calculating module 121 calculates frequency characteristics of spatial sound fields, an equalizer parameter, etc., based on audio data analysis. The UI generator 122 generates screen information for display on the display 12*a*, and sets coordinate information (pressed area) relative to the touch panel 12*b*, etc., so as to generate a user interface. The recording module 123 controls storing of audio data collected with the microphone 30 in the nonvolatile memory 20 or the RAM 21, and reproduction of audio data stored in the nonvolatile memory 20 or the RAM 21. The test sound outputting module 124 causes the sound device 200 described later to output test sound. The controller 120 controls actions of the calculating module 121, the UI generator 122, the recording module 123, and the test sound outputting module 124. The controller 120 also controls communication by the wireless communication module 23 in frequency characteristic correction processing.

The frequency characteristic correction program 110 can be obtained from an external network through wireless communication by the wireless communication module 23. Alternatively, the frequency characteristic correction program 110 may be obtained from a memory card in which the frequency characteristic correction program 110 is preliminarily stored, in a way such that the memory card is inserted into a memory slot (not illustrated). The CPU 16 installs the obtained frequency characteristic correction program 110 on the nonvolatile memory 20 in a given procedure.

The frequency characteristic correction program 110 has a module configuration comprising the modules described above (controller 120, calculating module 121, UI generator 122, recording module 123, and test sound outputting module 124). The CPU 16 reads out the frequency characteristic correction program 110 from the nonvolatile memory 20 and loads it on the RAM 21, so that the controller 120, the calculating module 121, the UI generator 122, the recording module 123, and the test sound outputting module 124 are generated on the RAM 21.

Figure 4:
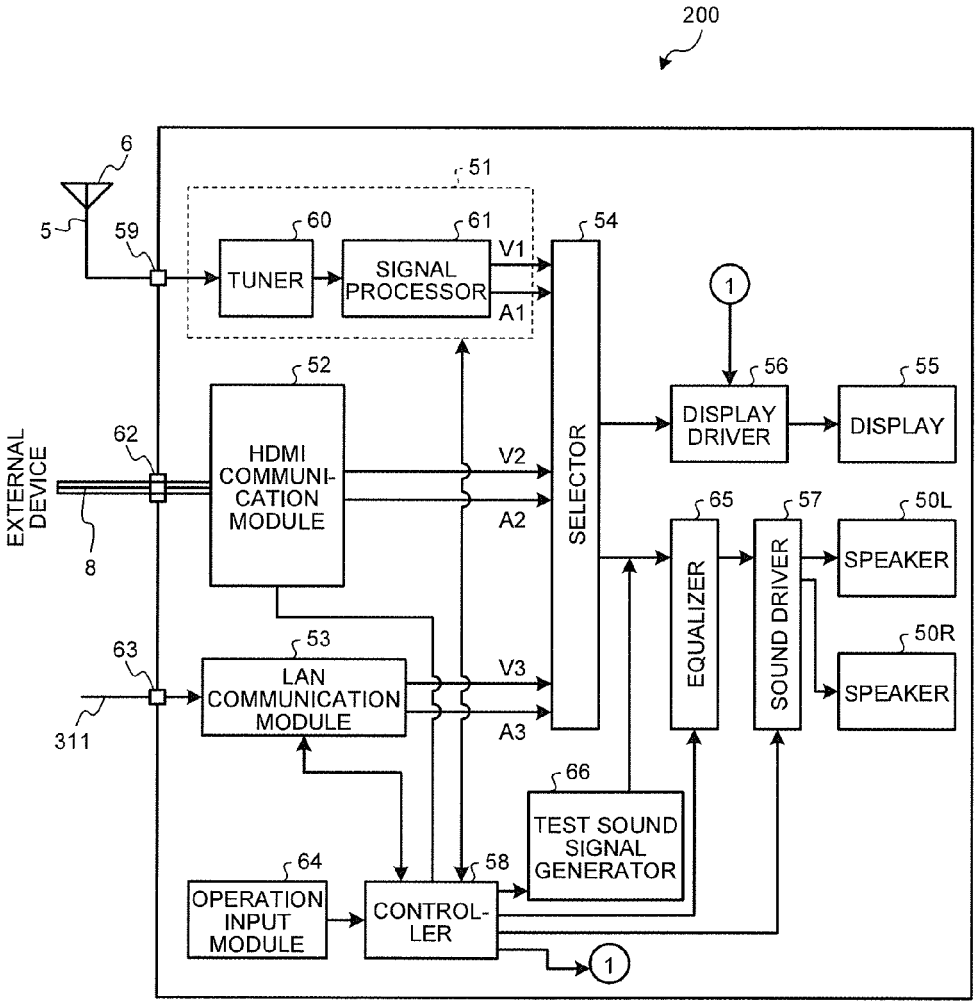
FIG. 4 is an exemplary block diagram of a configuration of a television receiver as a sound device in the embodiment.

FIG. 4 illustrates a configuration of an example of the television receiver as the sound device 200. The sound device 200 comprises a television function module 51, a high-definition multimedia interface (HDMI) communication module 52, a local area network (LAN) communication module 53, and a selector 54. The sound device 200 further comprises a display driver 56, a display 55, an equalizer 65, a sound driver 57, a controller 58, and an operation input module 64. In addition, the sound device 200 comprises the speakers 50L and 50R, and a test sound signal generator 66.

The controller 58 comprises a CPU, a RAM, and a read only memory (ROM), for example, and controls all actions of the sound device 200 using the RAM as a work memory, in accordance with a computer program preliminarily stored in the ROM.

The operation input module 64 comprises a receiver receiving wireless signals (infrared signals, for example) output from a remote control commander (not illustrated), and a decoder decoding the wireless signals to extract control signals. The control signals output from the operation input module 64 are supplied to the controller 58. The controller 58 controls actions of the sound device 200 in accordance with the control signals from the operation input module 64. In this way, the control of the sound device 200 through user operation is possible. Note that the operation input module 64 may be provided further with an operator receiving user operation and outputting given control signals.

The television function module 51 comprises a tuner 60, and a signal processor 61. The tuner 60 receives terrestrial digital broadcast signals, for example, by an antenna 6 connected to a television input terminal 59 through an aerial cable 5, and extracts given channel signals. The signal processor 61 restores video data V1 and audio data A1 from reception signals supplied from the tuner 60, and supplies the data to the selector 54.

The HDMI communication module 52 receives high-definition multimedia interface (HDMI) signals conforming to an HDMI standard that are transmitted from an external device through an HDMI cable 8 connected to a connector 62. The received HDMI signals are subjected to authentication processing of the HDMI communication module 52. When the received HDMI signals are successful in authentication, the HDMI communication module 52 extracts video data V2 and audio data A2 from the HDMI signals, and supplies the extracted data to the selector 54.

The LAN communication module 53 performs communication with an external device through a cable connected to a LAN terminal 63, using the TCP/IP as a communication protocol, for example. In the example of FIG. 4, the LAN communication module 53 is connected to the wireless transceiver 300 through the cable 311 from the LAN terminal 63, and performs communication through the wireless transceiver 300. In this manner, the communication becomes possible between the sound device 200 and the mobile terminal 100.

Alternatively, the LAN communication module 53 may be connected to a domestic network (not illustrated), for example, to receive internet protocol television (IPTV) transmitted through the domestic network. In this case, the LAN communication module 53 receives IPTV broadcast signals, and outputs video data V3 and audio data A3 that are obtained by decoding of the received signals by a decoder (not illustrated).

The selector 54 selectively switches data to be output among the video data V1 and the audio data A1 output from the television function module 51, the video data V2 and the audio data A2 output from the HDMI communication module 52, and the video data V3 and the audio data A3 output from the LAN communication module 53, under control of the controller 58 in accordance with the control signals from the operation input module 64, and outputs the selected data. The video data selected and output by the selector 54 is supplied to the display driver 56. The audio data selected and output by the selector 54 is supplied to the sound driver 57 through the equalizer 65.

The equalizer 65 adjusts frequency characteristics of the supplied audio data. To be more specific, the equalizer 65 corrects frequency characteristics controlling a gain in a specific frequency band of the audio data, in accordance with an equalizer parameter set by the controller 58. The equalizer 65 can be constituted by a finite impulse response (FIR) filter, for example. Alternatively, the equalizer 65 may be constituted using a parametric equalizer capable of adjusting gains and fluctuation ranges in a plurality of variable frequency points.

The equalizer 65 can be constituted using a digital signal processor (DSP). Alternatively, the equalizer 65 may be constituted by software using a part of functions of the controller 58.

The sound driver 57 performs digital to analog (D/A) conversion on the audio data output from the equalizer 65 into analog audio signals, and amplifies the signals so that the speakers 50L and 50R can be driven. The sound driver 57 can perform effect processing such as reverberation processing or phase processing, on the audio data output from the equalizer 65, under control of the controller 58. The audio data subjected to the D/A conversion is audio data on which the effect processing is already performed. The speakers 50L and 50R convert the analog audio signals supplied from the sound driver 57 into sound, and output it.

The test sound signal generator 66 generates test audio data, under control of the controller 58. The audio data for a test is audio data containing all elements of audible frequency bands, for example, and white noise, time stretched pulse (TSP) signals, sweep signals, etc., can be used. The test sound signal generator 66 may generate test audio data on a case-by-case basis. Alternatively, the test sound signal generator 66 may store preliminarily generated waveform data in a memory, and read out the waveform data from the memory, under control of the controller 58. The test audio data generated by the test sound signal generator 66 is supplied to the equalizer 65.

In the example, the test audio data is generated in the sound device 200. However, the embodiments are not limited thereto. The test audio data may be generated by the side of the mobile terminal 100, and supplied to the sound device 200. In this case, the test sound signal generator 66 may be omitted in the sound device 200.

As an example, referring to FIG. 2, the CPU 16 generates test audio data in accordance with the frequency characteristic correction program 110, and stores it in the RAM 21, etc., in the mobile terminal 100. The test audio data may be generated, and stored in the nonvolatile memory 20 preliminarily. The CPU 16 reads out the generated test audio data from the RAM 21 or the nonvolatile memory 20 at given timing, and transmits it from the wireless communication module 23 through wireless communication. For the transmission of test audio data through wireless communication, a communication standard defined by digital living network alliance (DLNA) can be applied.

The test audio data transmitted from the mobile terminal 100 is received by the wireless transceiver 300, input to the sound device 200 through the cable 311, and then supplied to the selector 54 from the LAN communication module 53. The selector 54 selects the audio data A3, so that the test audio data is supplied to the sound driver 57 through the equalizer 65, and output as sound from the speakers 50L and 50R.

The display driver 56 generates drive signals for driving the display 55 based on the video data output from the selector 54, under control of the controller 58. The generated drive signals are supplied to the display 55. The display 55 is constituted by an LCD, for example, and displays images in accordance with the drive signals supplied from the display driver 56.

Note that the sound device 200 is not limited to the television receiver, and may be an audio reproducing device reproducing a compact disk (CD) and outputting sound.

Figure 5:
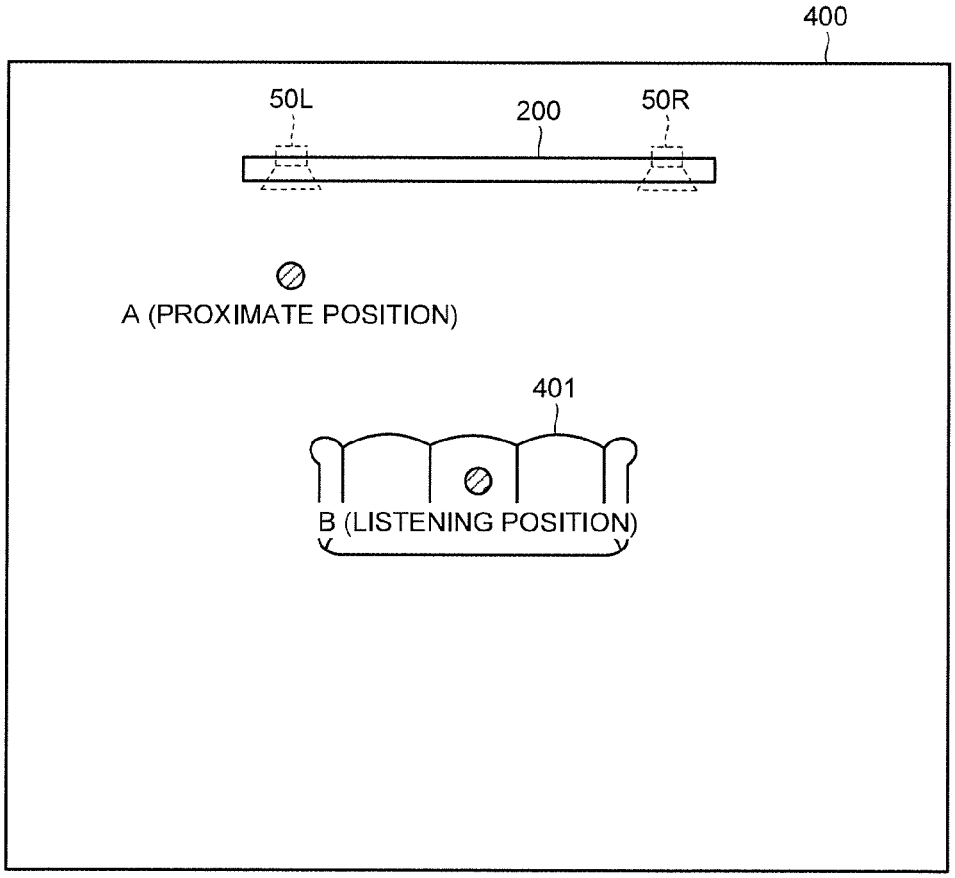
FIG. 5 is an exemplary diagram of an environment in which a sound device is arranged in the embodiment.

The frequency characteristic correction processing of spatial sound fields according to the embodiment is schematically described. FIG. 5 illustrates an example of an environment in which the sound device 200 is arranged. In the example of FIG. 5, the sound device 200 is arranged near a wall in a square room 400 surrounded by walls. The sound device 200 has the speaker 50L on the left end and the speaker 50R on the right end. In the room 400, a couch 401 is arranged at a position separated by a certain distance or more from the sound device 200. It is supported that a user listens to sound output from sound sources, i.e., the speakers 50L and 50R at a listening position B on the couch 401.

In the environment, sound output from the speakers 50L and 50R is reflected by each of walls of the room 400, and then reaches the listening position B. Therefore, sound at the listening position B is sound resulted by interference between direct sound reaching the listening position B from the speakers 50L and 50R and sound reflected by each of the walls, and probably has frequency characteristics different from those of sound output from the speakers 50L and 50R.

In the embodiment, at a proximate position A of the speaker 50L or 50R (speaker 50L, here) and at the listening position B, individually, the mobile terminal 100 records and obtains test sound output from the speaker 50L. The frequency characteristic of each test sound obtained individually at the proximate position A and the listening position B is calculated to find a difference between the frequency characteristic at the proximate position A and the frequency characteristic at the listening position B. The difference can be regarded as spatial sound field characteristics at the listening position B. Then, the frequency characteristic of the sound output from the speaker 50L is corrected using the inverse of the spatial sound field characteristics at the listening position B. The frequency characteristic of the sound output from the speaker 50L at the listening position B is corrected to be a target frequency characteristic. The target frequency characteristic may be of flat, that is, a characteristic in which sound pressure levels are flat in all audible frequency bands, for example. With such correction, at the listening position B, a user can listen to sound that is intended originally.

The frequency characteristic used for correction is calculated using a difference between frequency characteristics of sound that are recorded individually at two different positions with a same microphone. Thus, in correction, it is possible to suppress influences of the quality of the microphone and a measuring system.

Here, the proximate position A of the speaker 50L is set to be a position at which a ratio of the level of reflected sound resulted from reflection of sound output from the speaker 50L by walls, etc., relative to the level of direct sound output from the speaker 50L is equal to or more than a threshold. At the proximate position A of the speaker 50L, the sound pressure level of the direct sound output from the speaker 50L is sufficiently greater than that of the reflected sound resulted from reflection of sound output from the speaker 50L by surrounded walls, etc. Therefore, it is possible to regard a difference between the frequency characteristic measured at the proximate position A and the frequency characteristic measured at the listening position B as a spatial sound field characteristic at the listening position B.

The proximate position A is a position separated by a certain distance or more from the speaker 50L. This is because, when a measurement position is excessively near the speaker 50L, measurement results can be influenced by the directionality of the speaker 50L even if there is minor deviations between a direction of the microphone and a supposed angle relative to the speaker 50L.

In view of the aspects described above, when the room 400 is of normal size and structure, it is adequate that the proximate position A be a position separated by about 50 cm from the front face of the speaker 50L, for example. Note that the conditions of the proximate position A are varied depending on the size or structure of the room 400.

The target frequency characteristics are not limited to be flat. For example, the target frequency characteristics may be such that a given frequency band among audible frequency bands is emphasized or attenuated. Moreover, in the above, the measurement regarding the listening position B is performed at only one position. However, the embodiments are not limited thereto. For example, a frequency characteristic may be measured at each of a plurality of positions near the listening position B supposed, and the average value among the frequency characteristics of the positions may be used as a frequency characteristic at the listening position B.

Figure 6A:
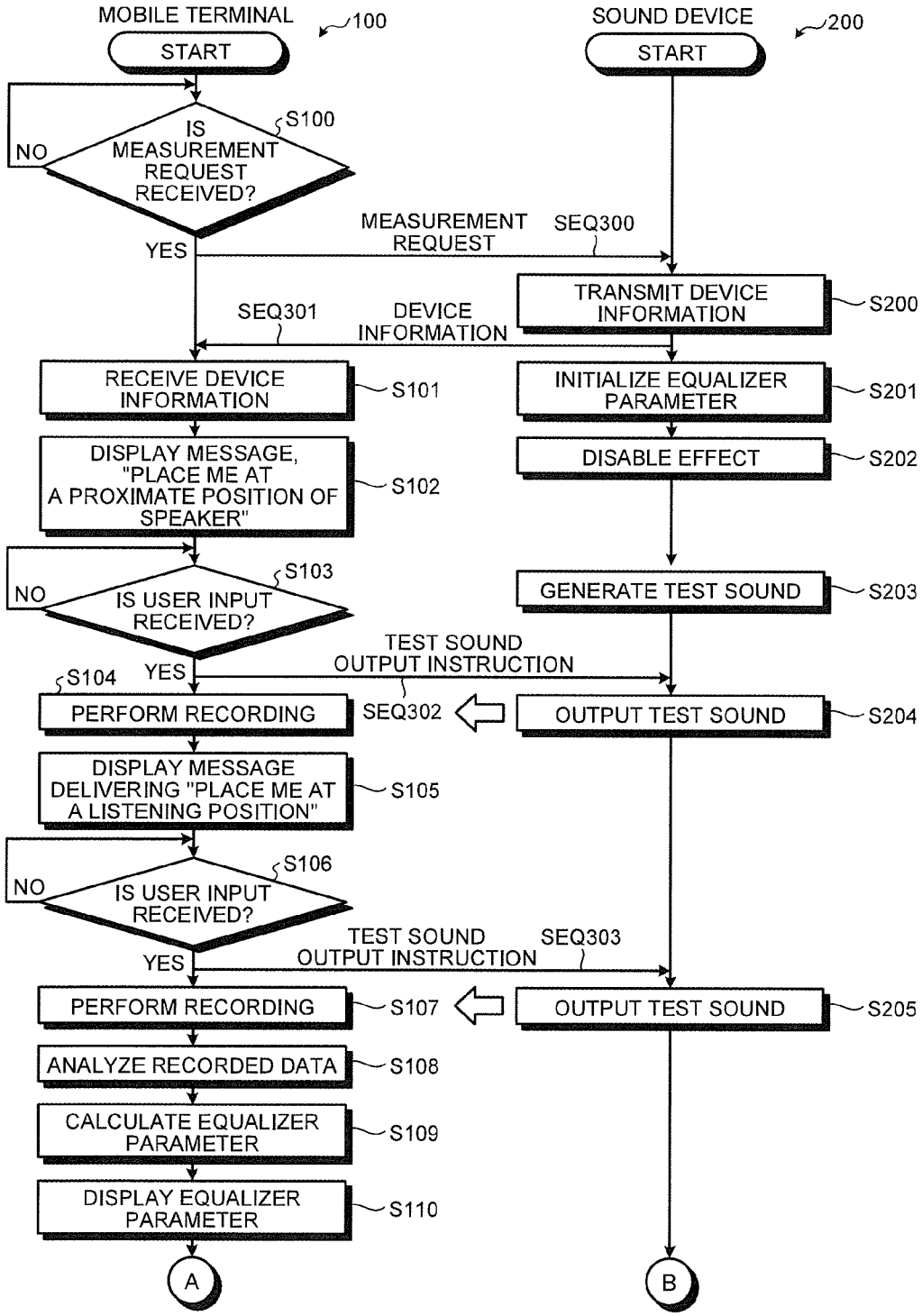
FIGS. 6A and 6B are exemplary flowcharts of processing of frequency characteristic correction of spatial sound fields in the embodiment.
Figure 6B:
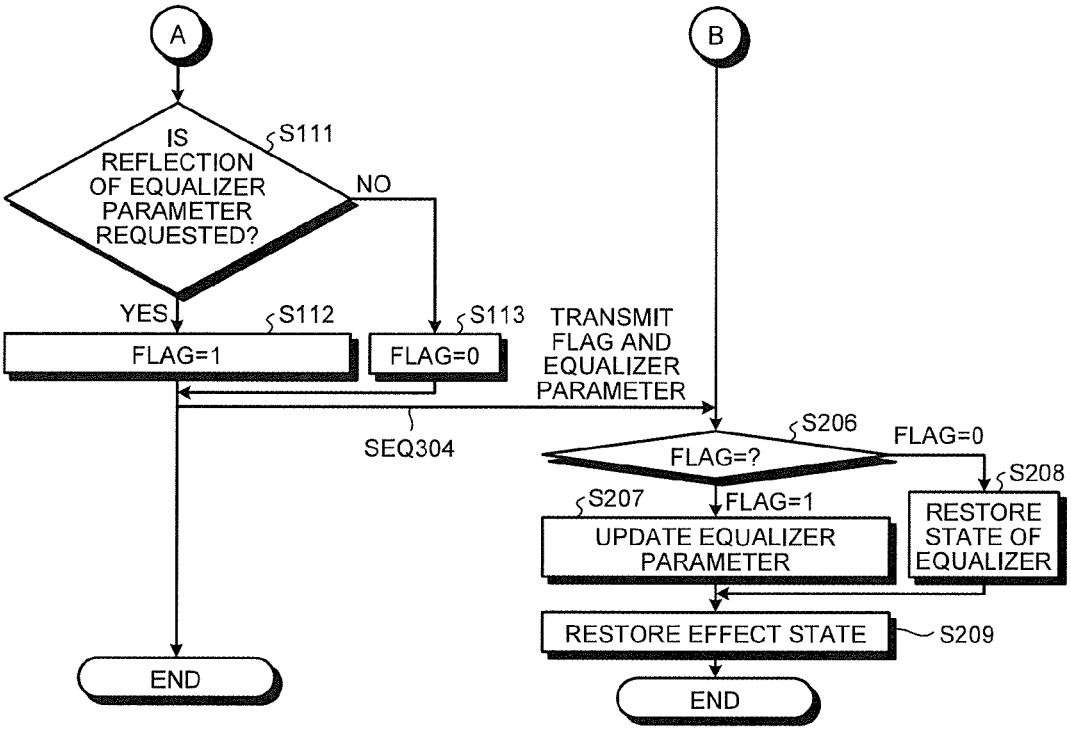

Next, the frequency characteristic correction processing of spatial sound fields of the embodiment is described in more detail with reference to FIG. 6A to FIG. 12. FIGS. 6A and 6B are flowcharts of an example of processing of the frequency characteristic correction of spatial sound fields in the embodiment. In FIGS. 6A and 6B, the flow on the left side is an example of processing in the mobile terminal 100, while the flow on the right side is an example of processing in the sound device 200. Each processing in the flow of the mobile terminal 100 is performed by the frequency characteristic correction program 110 preliminarily stored in the nonvolatile memory 20 of the mobile terminal 100 under control of the CPU 16. Each processing in the flow of the sound device 200 is performed by a computer program preliminarily stored in the ROM of the controller 58 of the sound device 200 under control of the controller 58.

In FIGS. 6A and 6B, the arrows between the flow of the mobile terminal 100 and the flow of the sound device 200 indicate transfer of information in wireless communication performed between the mobile terminal 100 and the sound device 200 through the wireless transceiver 300.

When a user activates the frequency characteristic correction program 110 in the mobile terminal 100, the mobile terminal 100 waits a measurement request from the user (S100). For example, in the mobile terminal 100, the frequency characteristic correction program 110 displays a screen exemplified in FIG. 7A on the display 12*a* of the user interface 12.

Figure 7A:
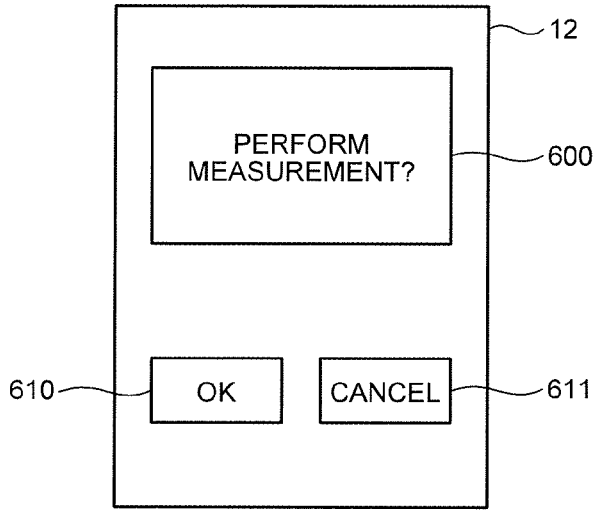
FIGS. 7A to 7C are exemplary diagrams each illustrating a screen displayed on a display of a mobile terminal in the embodiment.

In FIG. 7A, on the display, a message display area 600 in which a message for the user is displayed is arranged, and a button 610 for continuing processing (OK) and a button 611 for cancelling processing (CANCEL) are displayed. In the message display area 600, a message prompting the user to perform a given operation or processing is displayed, for example. At S100, a message prompting a measurement start request such as "PERFORM MEASUREMENT?" is displayed.

When the button 610 is pressed and the measurement is requested at S100, for example, the mobile terminal 100 notifies the sound device 200 of a measurement request (SEQ300). Receiving the notification, the sound device 200 transmits device information including parameters in the sound device 200 to the mobile terminal 100 at S200 (SEQ301). To be more specific, the device information includes an equalizer parameter that determines frequency characteristics in the equalizer 65, for example. The device information may further include parameters determining effect processing in the sound driver 57. The mobile terminal 100 receives device information transmitted from the sound device 200 at S101, and stores it in the RAM 21, for example.

After transmitting device information at S200, the sound device 200 initializes the equalizer parameter of the equalizer 65 at S201. Here, the sound device 200 stores the equalizer parameter immediately before initialization in the RAM, for example, of the controller 58. At the following S202, the sound device 200 disables effect processing in the sound driver 57. When the effect processing is disabled, each of the parameter values respecting effect processing is not changed, and only the effectiveness and ineffectiveness of the effect processing is switched. The embodiments are not limited thereto. After each of the parameters of effect processing is stored in the RAM, etc., each of them may be initialized.

It is also possible to configure so that the parameters included in the device information transmitted to the mobile terminal 100 in the above SEQ301 are the equalizer parameter or the parameters of effect processing immediately before initialization, so as to omit processing of storing the parameters in the RAM by the sound device 200.

At the following S203, the sound device 200 generates test sound (test audio signals) in the test sound signal generator 66, and waits (not illustrated) a test sound output instruction from the mobile terminal 100.

The test sound is not necessarily generated by the side of the sound device 200, and may be generated by the side of the mobile terminal 100. In this case, audio data of the test sound generated on the side of the mobile terminal 100 is transmitted to the sound device 200 from the mobile terminal 100 at timing of a test sound output instruction, which is described later.

Figure 7B:
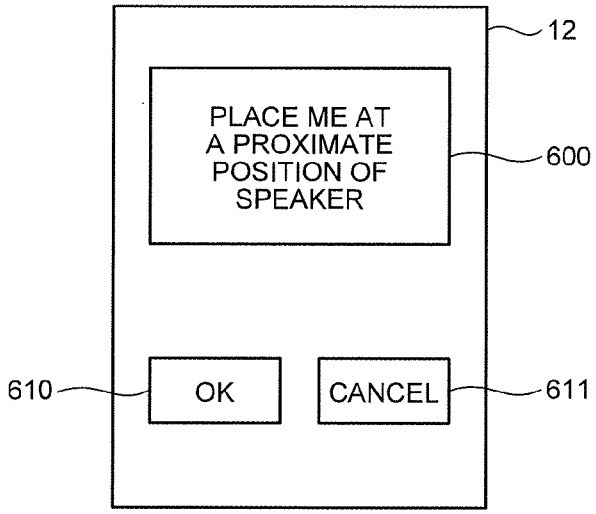

Receiving the device information from the sound device 200 at S101, the mobile terminal 100 displays, on the display 12*a*, a message prompting the user to place the microphone 30 (mobile terminal 100) at a proximate position (proximate position A in FIG. 5) of the speaker 50L or the speaker 50R (speaker 50L here) at S102. FIG. 7B illustrates an example of a screen displayed on the display 12*a* at S102. In the example, a message: "Place me at a proximate position of speaker" is displayed in the message display area 600.

At the following S103, the mobile terminal 100 waits a user input, i.e., a press of the button 610 on the screen exemplified in FIG. 7B. The user places the mobile terminal 100 at a proximate position of the speaker 50L (proximate position A in FIG. 5), and presses the button 610, indicating that the preparation for measurement is completed. When the button 610 is pressed, the mobile terminal 100 transmits a test sound output instruction to the sound device 200 (SEQ302). Receiving the test sound output instruction, the sound device 200 outputs the test sound generated at S203 from the speaker 50L at S204.

After transmitting the test sound output instruction to the sound device 200 in SEQ302, the mobile terminal 100 starts recording at S104, and measures a frequency characteristic at the proximate position A. For example, in the mobile terminal 100, analog audio signals collected with the microphone 30 are converted via the analog to digital conversion (A/D) into digital audio data by the sound processor 22, and then input to the system controller 17. The CPU 16 stores the audio data input to the system controller 17 in the nonvolatile memory 20, for example, and records it. The audio data obtained by recording at S104 is referred to as audio data at the proximate position.

Figure 7C:
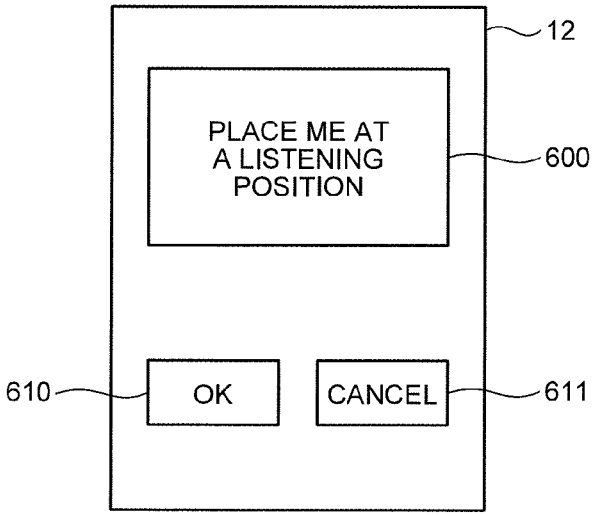

When the recording is finished at S104, the processing shifts to S105. Note that the finish of recording can be ordered by user operation on the mobile terminal 100. The embodiments are not limited thereto, and the recording finish timing may be determined based on a level of sound collected with the microphone 30. At S105, a message prompting the user to place the microphone 30 (mobile terminal 100) at a listening position (listening position B in FIG. 5) is displayed on the display 12*a*. FIG. 7C illustrates an example of a screen displayed on the display 12*a* at S105. In the example, a message: "Place me at a listening position" is displayed in the message display area 600.

At the following S106, the mobile terminal 100 waits a user input, i.e., a pressing of the button 610 on the screen exemplified in FIG. 7C. The user places the mobile terminal 100 at the listening position B, and presses the button 610, indicating that the preparation for measurement is completed. When the button 610 is pressed, the mobile terminal 100 transmits a test sound output instruction to the sound device 200 (SEQ303). Receiving the test sound output instruction, the sound device 200 outputs the test sound generated at S203 from the speaker 50L at S205.

After transmitting the test sound output instruction to the sound device 200 in SEQ303, the mobile terminal 100 starts recording at S107, and measures a frequency characteristic at the listening position B. The recorded test sound audio data is stored in the nonvolatile memory 20, for example. In the following, the audio data obtained by recording at S107 is referred to as audio data at the listening position.

At the following step S108, the mobile terminal 100 analyzes the frequency of audio data at the proximate position and the frequency of audio data at the listening position, and calculates a frequency characteristic of each of them. For example, in the mobile terminal 100, the CPU 16 performs fast fourier transform (FFT) processing on each of the audio data at the proximate position and the audio data at the listening position, in accordance with the frequency characteristic correction program 110, and finds a frequency characteristic, i.e., a sound pressure level of each of frequencies.

Figure 8:
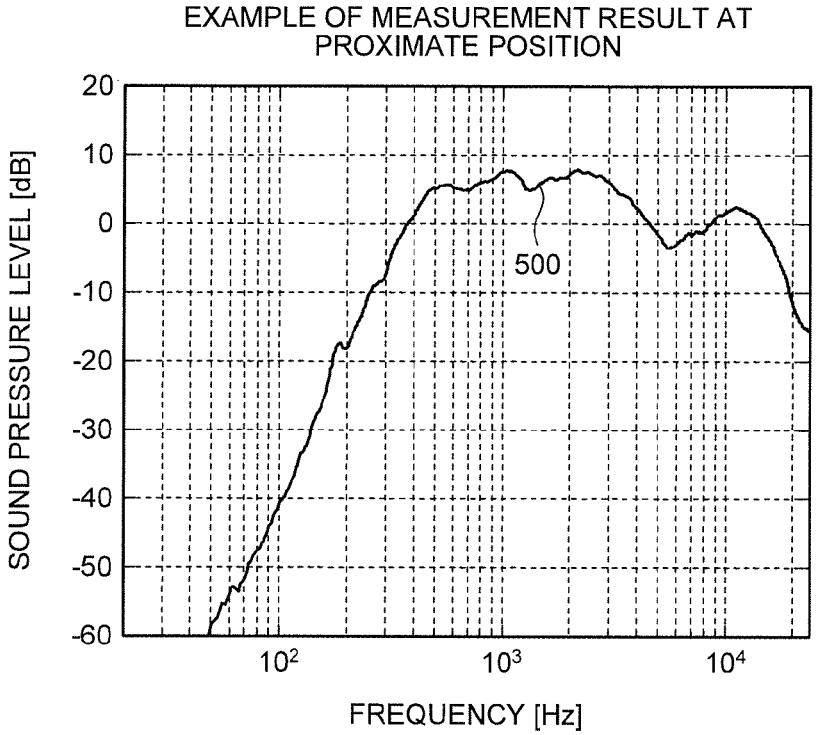
FIG. 8 is an exemplary graph illustrating frequency characteristic as an analysis result of audio data at a proximate position in the embodiment.
Figure 9:
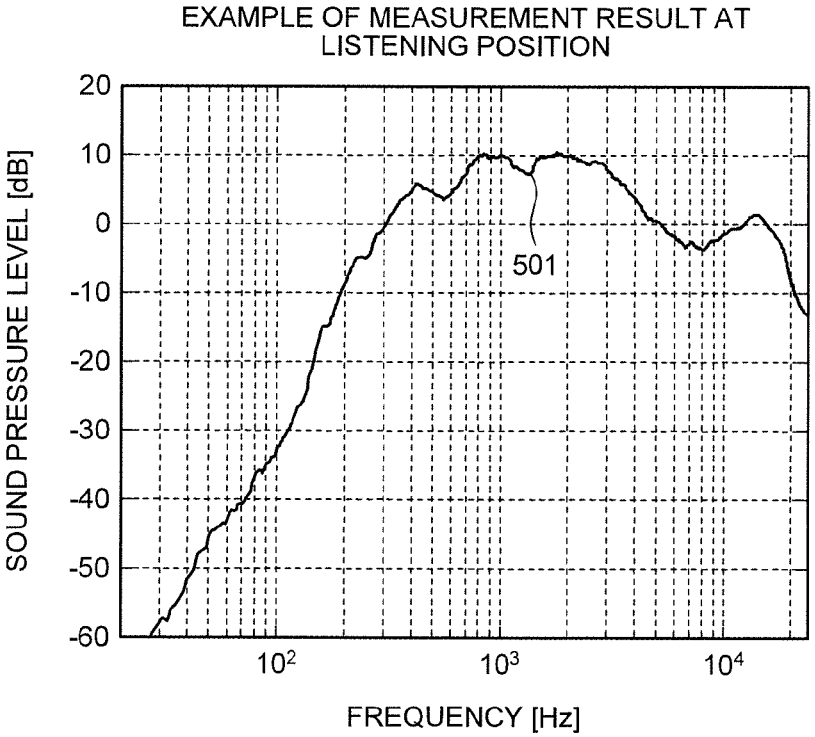
FIG. 9 is an exemplary graph illustrating frequency characteristic as an analysis result of audio data at a listening position in the embodiment.
Figure 10:
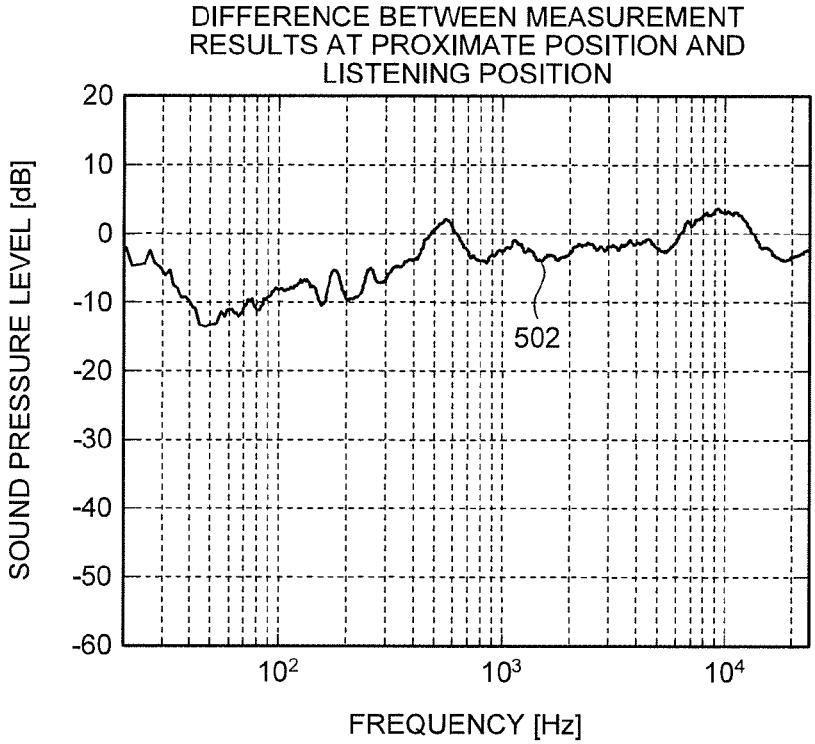
FIG. 10 is an exemplary graph illustrating a spatial sound field characteristic in the embodiment.

FIG. 8 illustrates an example of a frequency characteristic 500 as an analysis result of audio data at the proximate position. FIG. 9 illustrates an example of a frequency characteristic 501 as an analysis result of audio data at the listening position. In FIG. 8 and FIG. 9, and FIG. 10 that is described later, the vertical axis represents the sound level (dB), and the horizontal axis represents the frequency (Hz).

At the following S109, the mobile terminal 100 calculates a correction value (equalizer parameter) for correcting the frequency characteristic of the equalizer 65 of the sound device 200, based on the frequency characteristics 500 and 501 of respective audio data at the proximate position and at the listening position that are calculated at S108. Here, the equalizer frequency characteristic of the equalizer 65 is corrected so that the frequency characteristic at the listening position of the sound output from the speaker 50L are flat, for example, the sound pressure levels are same in all audible frequency bands.

The mobile terminal 100 first calculates a difference between the frequency characteristic 500 of audio data at the proximate position and the frequency characteristic 501 of audio data at the listening position. The difference represents a spatial sound field characteristic at the listening position B when the speaker 50L is a sound source. The mobile terminal 100 regards a frequency characteristic indicative of the inverse of the calculated spatial sound field characteristics as the equalizer frequency characteristic of the equalizer 65.

Figure 11:
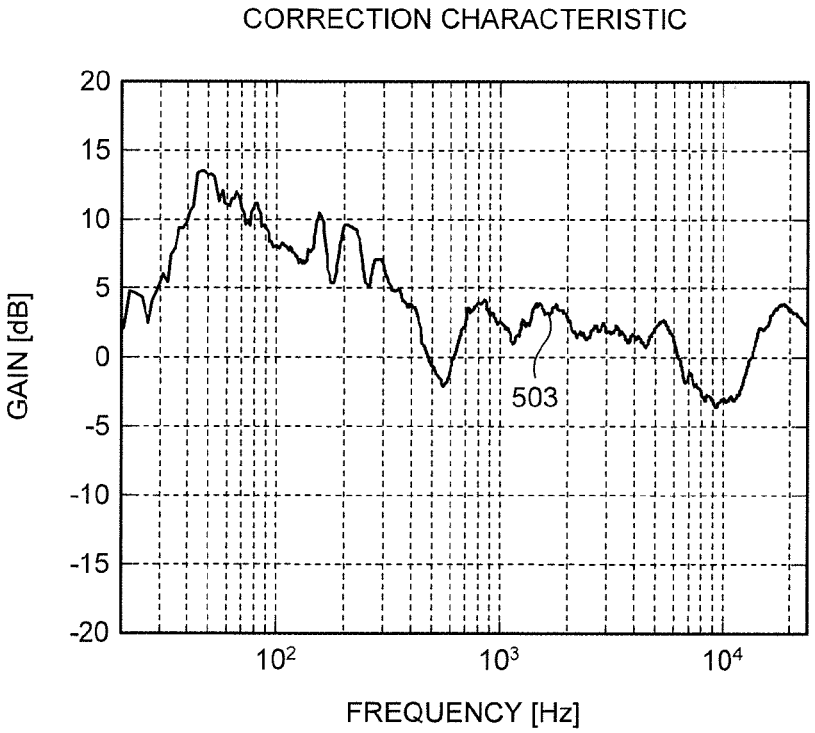
FIG. 11 is an exemplary graph illustrating a correction frequency characteristic in the embodiment.

FIG. 10 illustrates an example of a spatial sound field characteristic 502 resulted by reducing the frequency characteristic 501 of the audio data at the listening position from the frequency characteristic 500 of the audio data at the proximate position. The mobile terminal 100 calculates the inverse of the spatial sound field characteristic 502, i.e., a correction frequency characteristic in which the sound pressure level in each frequency of the spatial sound field characteristic 502 is corrected to 0 dB. FIG. 11 illustrates an example of a correction frequency characteristic 503 relative to FIG. 10. In FIG. 11, the vertical axis represents the gain (dB), and the horizontal axis represents the frequency (Hz). The correction frequency characteristic 503 can be calculated by reducing a sound level of each frequency in the spatial sound field characteristic 502 from 0 dB, for example.

After calculating the correction frequency characteristic 503 as illustrated in FIG. 11, the mobile terminal 100 calculates an equalizer parameter that matches or approximates the frequency characteristic of the equalizer 65 to the calculated correction frequency characteristic 503. As a method of calculating the equalizer parameter, the least mean square (LMS) algorithm can be used.

After calculating the equalizer parameter, the mobile terminal 100 presents the calculated equalizer parameter to the user at S110, and inquires the user if the equalizer parameter is reflected in the equalizer 65 of the sound device 200 at the following S111.

Figure 12:
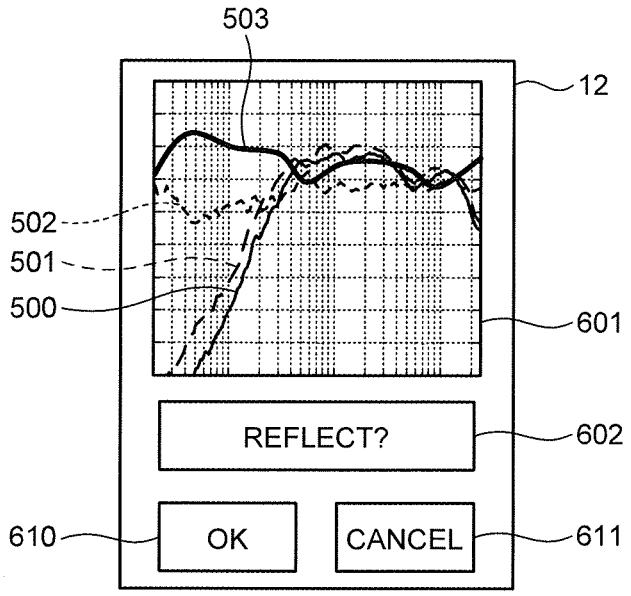
FIG. 12 is an exemplary graph illustrating a screen displayed on a display of a mobile terminal in the embodiment.

FIG. 12 illustrates an example of a screen displayed on the display 12*a* at S110. The equalizer parameter is displayed in a display area 601. In the example of FIG. 12, the correction frequency characteristic 503 is simplified and displayed as an equalizer parameter in the display area 601. In the example of FIG. 12, the frequency characteristic 500 of the audio data at the proximate position, the frequency characteristic 501 of the audio data at the listening position, and the spatial sound field characteristic 502 are overlapped on the correction frequency characteristic 503, for display.

Furthermore, in FIG. 12, a message prompting the user to input if the equalizer parameter is reflected in the equalizer 65 of the sound device 200, such as of "Reflect?", is displayed in a message display area 602.

When the button 610 is pressed at S111, the mobile terminal 100 determines that the equalizer parameter is to be reflected, and shifts the processing to S112. At S112, the mobile terminal 100 sets a flag value (FLAG) to a value ("1", for example) representing that the equalizer parameter is to be reflected. On the other hand, when the button 611 is pressed at S111, the mobile terminal 100 determines that the equalizer parameter is not to be reflected, and shifts the processing to S113. At S113, the mobile terminal 100 sets a flag value (FLAG) to a value ("0", for example) representing that the equalizer parameter is not to be reflected.

When the flag value (FLAG) is set at S112 or S113, the mobile terminal 100 transmits, in SEQ304, the set flag value (FLAG) to the sound device 200 together with the value of the equalizer parameter calculated at S109. Note that, when the flag value (FLAG) is a value representing that the equalizer parameter is not to be reflected, the transmission of the equalizer parameter can be omitted. Once the transmission of the flag (FLAG) and the equalizer parameter is completed in SEQ304, a series of processing on the mobile terminal 100 is finished.

Receiving the flag value (FLAG) and the equalizer parameter transmitted from the mobile terminal 100 in SEQ304, the sound device 200 performs determination based on the flag value (FLAG) at S206.

When the sound device 200 determines, at S206, that the flag value (FLAG) is a value ("1", for example) representing that the equalizer parameter is to be reflected, it shift the processing to S207. At S207, the sound device 200 updates the equalizer parameter of the equalizer 65 by the equalizer parameter transmitted together with the flag value (FLAG) from the mobile terminal 100 in SEQ304, and thus reflects the equalizer parameter calculated at S109 in the equalizer 65.

On the other hand, when the sound device 200 determines, at S206, that the flag value (FLAG) is a value ("0", for example) representing that the equalizer parameter is not to be reflected, it shift the processing to S208. At S208, the sound device 200 restores the state of the equalizer 65 to the state before the equalizer parameter initialization processing is performed at S201. For example, the sound device 200 sets the equalizer parameter stored in the RAM at S201 to the equalizer 65.

When the processing at S207 or S208 is finished, the sound device 200 shifts the processing to S209 to enable the effect state, and thus restores the effect state from the disabled state at S202. Once the effect state is restored at S209, a series of processing on the side of the sound device 200 is finished.

As described above, in the embodiment, the frequency characteristics are measured individually at the proximate position and the listening position of the sound source, using the same microphone, and based on the difference between the frequency characteristic at the proximate position and the frequency characteristic at the listening position, the equalizer parameter is calculated. This enables correction of the frequency characteristic of the equalizer that does not depend on the quality of the microphone (measurement system) used for measurement.

Since the correction not depending on the quality of the microphone is possible, a system that requires less later work can be configured, as compared with a case in which calibration of microphone characteristics is performed depending on manufacturers or models.

Furthermore, since the equalizer parameter is calculated based on the difference between the frequency characteristic at the proximate position and the frequency characteristic at the listening position, it is possible to reserve characteristics that is added intentionally by a designer of the sound device 200 even after the equalizer parameter is corrected.

Moreover, the various modules of the systems described herein can be implemented as software applications, hardware and/or software modules, or components on one or more computers, such as servers. While the various modules are illustrated separately, they may share some or all of the same underlying logic or code.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sound processor comprising:

a communication module configured to communicate with a sound device;

a test sound outputting module configured to cause the sound device to output test sound through the communication module;

a recording module configured to record sound collected with a sound input device;

a display configured to display a message;

an input module configured to receive a user input;

a controller configured to (i) display, on the display, a first message prompting a user to move the sound input device to a position proximate to a speaker of the sound device so as to record first sound, (ii) cause the test sound outputting module to output the test sound in accordance with a user input made with respect to the input module in response to the first message and cause the recording module to record the first sound, (iii) display, after the first sound is recorded, on the display, a second message prompting the user to move the sound input device to a listening position so as to record second sound, and (iv) cause the test sound outputting module to output the test sound in accordance with a user input made with respect to the input module in response to the second message and cause the recording module to record the second sound; and a calculating module configured to find a first frequency characteristic of the first sound recorded with the recording module and a second frequency characteristic of the second sound recorded with the recording module, and calculate, based on a difference between the first frequency characteristic and the second frequency characteristic, a correction value for correcting the second frequency characteristic to a target frequency characteristic.

2. The sound processor of claim 1, wherein the calculating module is configured to transmit the correction value to the sound device through the communication module.

3. The sound processor of claim 2, wherein the controller is configured to obtain control information for controlling at least a frequency characteristic from the sound device through the communication module before the correction value is transmitted to the sound device, and to transmit the control information to the sound device in accordance with a user input made with respect to the input module after the calculating module calculates the correction value.

4. The sound processor of claim 1, wherein the target frequency characteristic is a frequency characteristic in which sound pressure levels are flat in all audible frequency bands.

5. The sound processor of claim 1, wherein the calculating module is configured to calculate the second frequency characteristic by averaging a frequency characteristic of the second sound recorded at a plurality of positions near the listening position.

6. A sound processing method comprising:

outputting test sound by causing a sound device to output the test sound through a communication module;

recording first sound collected with a sound input device;

first displaying, on a display, a first message prompting a user to move the sound input device to a position proximate to a speaker of the sound device so as to record first sound;

first instructing the outputting to output the test sound in accordance with a user input made with respect to an input module in response to the first massage and instructing the recording to record the first sound;

second displaying, after the first sound is recorded, on the display, a second message prompting the user to move the sound input device to a listening position so as to record second sound;

second instructing the outputting to output the test sound in accordance with a user input made with respect to the input module in response to the second message and instructing the recording to record the second sound; and calculating a first frequency characteristic of the first sound recorded at the first instructing and a second frequency characteristic of the second sound recorded at the second instructing, and calculating, based on a difference between the first frequency characteristic and the second frequency characteristic, a correction value for correcting the second frequency characteristic to a target frequency characteristic.

7. A computer program product having a non-transitory computer readable medium including programmed instructions, wherein the instructions, when executed by a computer, cause the computer to perform:

outputting test sound by causing a sound device to output the test sound through a communication module;

recording first sound collected with a sound input device;

first displaying, on a display, a first message prompting a user to move the sound input device to a position proximate to a speaker of the sound device so as to record first sound;

first instructing the outputting to output the test sound in accordance with a user input made with respect to an input module in response to the first massage and instructing the recording to record the first sound;

second displaying, after the first sound is recorded, on the display, a second message prompting the user to move the sound input device to a listening position so as to record second sound;

second instructing the outputting to output the test sound in accordance with a user input made with respect to the input module in response to the second message and instructing the recording to record the second sound; and calculating a first frequency characteristic of the first sound recorded at the first instructing and a second frequency characteristic of the second sound recorded at the second instructing, and calculating, based on a difference between the first frequency characteristic and the second frequency characteristic, a correction value for correcting the second frequency characteristic to a target frequency characteristic.

* * * * *